US009777523B2

(12) United States Patent
Choi et al.

(10) Patent No.: US 9,777,523 B2
(45) Date of Patent: Oct. 3, 2017

(54) HOME APPLIANCE HAVING MOVABLE DOOR HANDLE

(71) Applicant: LG ELECTRONICS INC., Seoul (KR)

(72) Inventors: Moonho Choi, Seoul (KR); Euisu Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 158 days.

(21) Appl. No.: 14/853,425

(22) Filed: Sep. 14, 2015

(65) Prior Publication Data

US 2016/0076289 A1 Mar. 17, 2016

(30) Foreign Application Priority Data

Sep. 16, 2014 (KR) ..... 10-2014-0122493

(51) Int. Cl.

| | |
|---|---|
| ***E05D 15/04*** | (2006.01) |
| ***E06B 3/34*** | (2006.01) |
| ***E06B 3/38*** | (2006.01) |
| ***E06B 3/36*** | (2006.01) |
| ***E05B 1/00*** | (2006.01) |
| ***A47L 15/42*** | (2006.01) |

(Continued)

(52) U.S. Cl.

CPC ..... *E05D 15/04* (2013.01); *A47L 15/4259* (2013.01); *D06F 39/14* (2013.01); *E05B 1/00* (2013.01); *E06B 3/34* (2013.01); *E06B 3/36* (2013.01); *E06B 3/38* (2013.01); *F24C 15/024* (2013.01); *F25D 23/028* (2013.01)

(58) Field of Classification Search

CPC ..... E05Y 2900/20

USPC ..... 312/409, 326, 328; 16/436, 438; 126/192, 197, 190, 273 R, 37 R, 39 B; 394/394

See application file for complete search history.

(56) References Cited

U.S. PATENT DOCUMENTS

2005/0023946 A1* 2/2005 Bartmann ..... F24C 15/023 312/328
2005/0034381 A1 2/2005 Bartmann et al.
2014/0035453 A1 2/2014 Kwon et al.

FOREIGN PATENT DOCUMENTS

DE 102 51 231 A1 5/2004
DE 10 2004 059 563 A1 2/2006

(Continued)

OTHER PUBLICATIONS

European Search Report dated Jan. 7, 2016 issued in Application No. 15185205.0.

*Primary Examiner* — Matthew Ing
(74) *Attorney, Agent, or Firm* — KED & Associates, LLP

(57) ABSTRACT

A home appliance comprises a cabinet having a chamber, a door configured to open or close the chamber by being rotated about a door rotating shaft, and a handle assembly provided at the exterior of a front surface of the door. The handle assembly includes a handle configured to assist a user in opening or closing the door, a handle link rotating shaft, a handle link attached to the handle, and a distance spacer provided between the handle link and the handle link rotating shaft to maintain a distance between the handle link and the handle link rotating shaft. The handle link is rotatable about the handle link rotating shaft as the door is rotated to an open position and extends out of the door in an increasing length as an opening angle of the door increases.

19 Claims, 7 Drawing Sheets

(51) Int. Cl.

| | |
|---|---|
| ***D06F 39/14*** | (2006.01) |
| ***F24C 15/02*** | (2006.01) |
| *F25D 23/02* | (2006.01) |

(56) References Cited

FOREIGN PATENT DOCUMENTS

| | | | |
|---|---|---|---|
| JP | 2010-251610 | | 11/2010 |
| KR | 10-2004-0059678 | A | 7/2004 |
| KR | 10-2007-0018451 | | 2/2007 |
| KR | 10-2014-0018565 | A | 2/2014 |
| KR | 10-1370923 | B1 | 3/2014 |

* cited by examiner

HOME APPLIANCE HAVING MOVABLE DOOR HANDLE

CROSS-REFERENCE TO RELATED APPLICATION

This application claims priority under 35 U.S.C. §119 to Korean Application No. 10-2014-0122493, filed on Sep. 16, 2014, whose entire disclosure is hereby incorporated by reference.

BACKGROUND

1. Field

The present disclosure relates to a home appliance having a door, and more particularly, to a home appliance configured to assist a user in easily opening or closing a door.

2. Background

Home appliances may refer to products that perform a variety of functions using electricity or other energy at home or indoors. Examples of home appliances may include a washing apparatus for washing or drying laundry, a refrigerator for keeping food at a refrigerating or freezing temperature, a dishwasher for washing dishes, and gas or electric ovens or microwave ovens for cooking food. Of course, in addition to the aforementioned examples, various other types of home appliances may be present.

In many cases, home appliances may include a cabinet defining the external appearance of the home appliance. In turn, a chamber in which an object is received may be defined in the cabinet, and the cabinet may define the chamber. For example, the chamber may be configured into various shapes according to the types or purposes thereof, such as a space for cooking food, a space for washing laundry, a space for storage or processing of clothes, a space for washing dishes, or a space for storage of food, for example. Of course, the chamber may be referred to by various names according to the purposes or usages of home appliances.

The home appliances may include a door configured to be opened or closed for entrance or exit of an object. The door may be provided with a handle to assist a user in opening or closing the door by gripping the handle with the hand. As the capacity of the home appliance, i.e. the capacity of the chamber increases, the size of the door increases, which problematically increases the weight of the door. Therefore, there is a need to assist the user in easily opening or closing the door using the handle despite the size and weight of the door for enhanced user convenience.

FIG. 1 illustrates an oven or dishwasher among home appliances. As illustrated, a handle 40 is provided at an upper portion of a front surface of a door 30, and the door 30 is opened or closed via pivotal rotation thereof about the bottom thereof as a pivot center. The handle 40 is fixed to the door 30. To open or close the door 30, the user has to grip and pull the handle 40 provided at a front surface of the cabinet 20, and simultaneously apply downward force to the handle 40. This type of door may be referred to as a pull-down type door.

In many cases, when opening the door 30, the user "a" will grip the handle 40 with the hand such that the back of the hand "b" faces upward. In this case, the wrist of the user will inevitably be bent as the door 30 is opened, and even the situation in which the back of the hand "b" is pushed by an upper edge 30*a* of the door 30 may occur. Although changing a hand's posture of gripping the handle 40 in the course of opening the door 30 may be considered to eliminate this discomfort, this is not easy because changing from the hand that has already gripped the handle 40 to the other hand is inconvenient.

On the other hand, it may be contemplated for the user to open the door 30 by gripping the handle 40 with the hand such that the palm faces upward. However, even in this case, the wrist of the user will be bent and the wrist or the palm may be pushed by the edge 30*a*.

As exemplarily illustrated in FIG. 1, the handle 40 also deviates or is blocked from the visual field of the user in a state in which the door 30 is rotated and opened to some extent. In particular, in a state in which the door 30 is rotated by 90 degrees and is completely opened, the user cannot see the handle 40, and it is inconvenient for the user to grip the handle 40 when closing the door 30.

In the case of opening or closing the door using the above-described handle, use of the handle may not be easy because the user must move various joints and muscles, such as the wrist, the arm, the knee, or the shoulder. In addition, since an increase in the capacity of home appliances entails an increase in the size and weight of the door, user inconvenience caused by the opening or closing of the door may further increase.

For various reasons, there is a need for provision of convenient home appliances that adopt an ergonomic handle design to minimize labor and discomfort of the user when opening or closing the door. The applicant proposed Korean Patent Application No. 10-2012-0084830 (Patent Registration No. 10-1370923) (hereinafter referred to as "preceding disclosure"), in order to solve the problems with general home appliances having a door as illustrated in FIG. 1.

The preceding disclosure proposed a home appliance in which the rotation of a handle link connected to a handle and the rotation of a door are linked to each other such that the handle is rotated as the door is rotated. This rotation linkage may occur by a mechanism in which a distance between a rotating shaft of the door and a rotating shaft of a link enables the link to rotate the handle link as the door is rotated. However, the preceding disclosure proposes only a basic mechanism for the linkage between the handle and the door and has many problems in terms of application to products in practice.

In one example, when a significantly large vertical load is applied to the handle, the handle link may be damaged. When an upward or downward vertical force is applied to the handle, the upward or downward vertical force is substantially applied to the rotating shaft of the door. Thus, no moment to rotate the door results, which means that great force is applied to the handle link. In particular, when attempting to move the home appliance by gripping the handle, the load of the home appliance may be applied through the handle, which may cause damage to the handle link.

In addition, the radius of rotation of the handle link or the handle is much smaller than the radius of rotation of the door, resulting in shaking of the handle or the handle link while the door is closed. The handle may be forwardly and rearwardly spaced apart from the door, rather than coming into close contact with the front surface of the door, when the door is in a closed state.

Accordingly, the preceding disclosure proposes only the basic mechanism and may not ensure the reliability of a product in terms of application to the product in practice.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
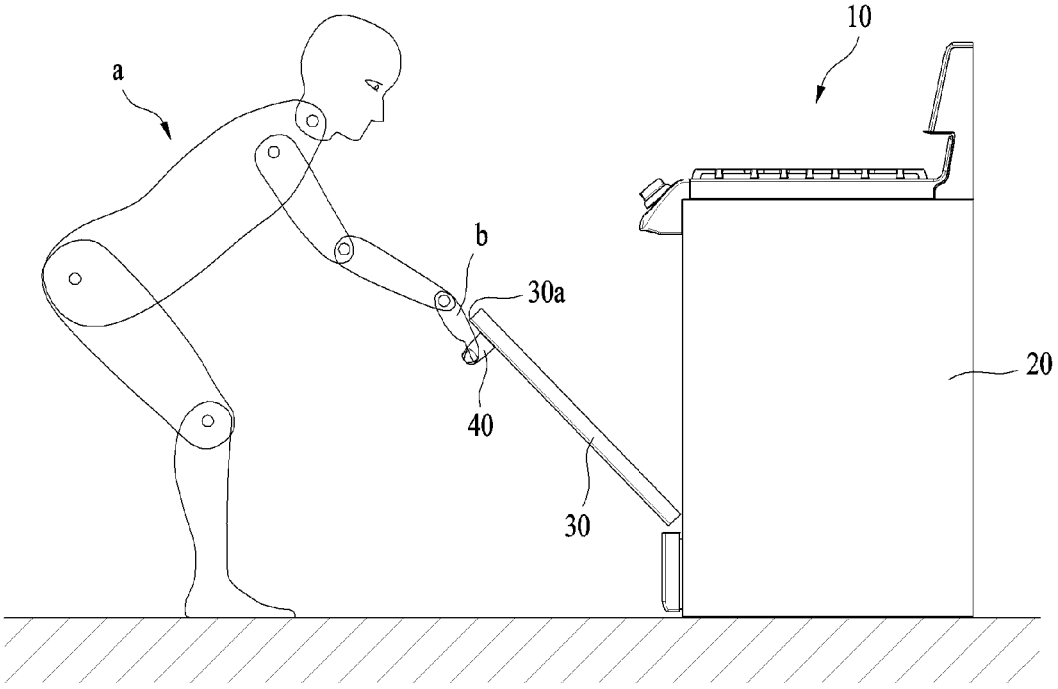
FIG. 1 is a schematic view illustrating an opening or closing operation of a door provided in a conventional home appliance.
Figure 2:
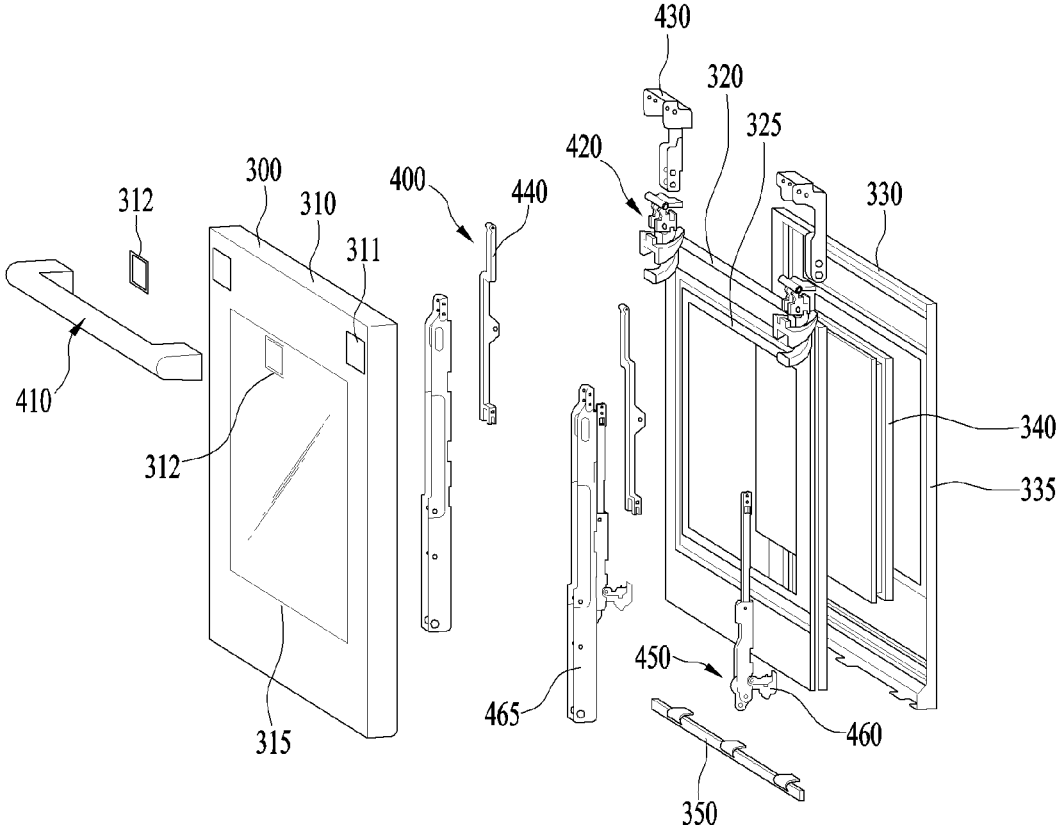
FIG. 2 is an exploded perspective view illustrating a door of a home appliance according to one embodiment of the present disclosure.

FIG. 2 is an exploded perspective view illustrating one example of components according to one embodiment of the present disclosure. The present disclosure relates, more particularly, to a door and a handle provided to open or close the door and, therefore, some components of the home appliance such as, for example, a cabinet (20, see FIG. 1), are not illustrated.

A door 300 is connected to the cabinet to open or close a chamber in which an object is received. The door 300 is provided with a handle 410. A user opens or closes the door 300 by gripping the handle 410 with the hand.

The door 300 may include a plurality of panels. The door 300 may include a front panel 310 which defines the front surface of the door 300 and a rear panel 330 which defines the rear surface of the door 300. A prescribed space may be defined between the front panel 310 and the rear panel 330 to receive various components.

An intermediate panel 320 may be provided between the front panel 310 and the rear panel 330. The panels 310, 320 and 330 may be centrally provided with windows or openings 315, 325 and 335 to enable the interior of the chamber to be viewed from the outside. A window or glass panel 340 may be fitted to each window.

The door 30 may be prepared as the front panel 310, the rear panel 330, the intermediate panel 320, and the window panel 340, are coupled to one another. In addition, a shielding panel 350 may be provided at the lower end of the door 300. The shielding panel 350 may define the lower surface of the door 300.

Generally, hinge structures (e.g., 460) may be provided inside the door 300 to enable the opening or closing of the door 300. In addition, damper structures (e.g., 450) may be provided to prevent the door 300 from being opened any further in the maximally opened state thereof, or to cause the door 300 to be smoothly opened or closed.

The hinge 460 may be provided at the lower end of the door 300 so as to define a rotating shaft of the door 300. As the hinge 460 is connected to the door 300 and the cabinet, the door 300 is rotatable relative to the cabinet. The hinge 460 and the damper 450 may be provided at either side of the door 300 to ensure the more stable opening and closing of the door 300 although only one is shown in the drawings.

The present embodiment may relate to the door 300, which enables the handle 410 to vary in position as the door 300 is opened or closed, rather than the door which is simply opened or closed via the handle 410, and the home appliance including the door 300. One example of such a home appliance may be an oven. Accordingly, in the present embodiment, the rotation angle of the door 300 may be linked to the rotation of the handle 410 and, to this end, a handle assembly 400 may be provided.

The handle assembly 400 may include the handle 410 provided at the front surface of the door 300 and at least one handle link 420 connected to the handle 410. The handle link 420 is rotated as the door 300 is rotated. The angle of rotation of the handle link 420 may be directly converted into the rotation of the handle 410. In other words, the handle link 420 and the handle 410 may rotate together.

The handle link 420 may be located inside the door 300. As the door 300 is rotated, a portion of the handle link 420 may be exposed out of the door 300. The handle link 420 may move to the inside or outside of the door 300 through at least one handle penetration hole 311 formed in the front surface of the door 300, or more particularly, formed in the front panel 310. The length of the handle link 420, exposed out of the door 300 through the penetration hole 311, increases as the opening angle of the door 300 increases.

At least one contact member 312 may be provided near the penetration hole 311 to protect the penetration hole 311 and to protect the handle link 420 moving through the penetration hole 311. The handle link 420 and the handle 410 may be coupled to each other in the front or rear of the contact member 312 or in the front or rear of the penetration hole 311. With this configuration, the handle 410 may always be exposed out of the door 300 regardless of the position or opening angle of the door 300, whereas the handle link 420 may be partially exposed out of the door 300 according to the opening angle of the door 300.

At least one handle link bracket 430 may be provided inside the door 300 to support the handle link 420. The handle link bracket 430 may be fixed inside the door 300. Accordingly, it is possible to prevent force applied to the handle link 420 from being directly transmitted to the door 300. Through the provision of the handle link bracket 430, the handle link 420 may be more stably movable relative to the door 300.

The handle assembly 400 may include at least one link 440 which converts the angle of rotation of the door 300 into the angle of rotation of the handle link 420. Of course, the link 440 may not constitute the handle assembly 400, but may be part of the damper assembly or a hinge assembly having a damper or hinge. The link 440 is provided inside the door 300 to rotate the handle link 420 as the door 300 is rotated. The rotation of the door 300 may be transferred to as rotation of the handle 410 and the handle link 420 through the link 440.

Figure 3:
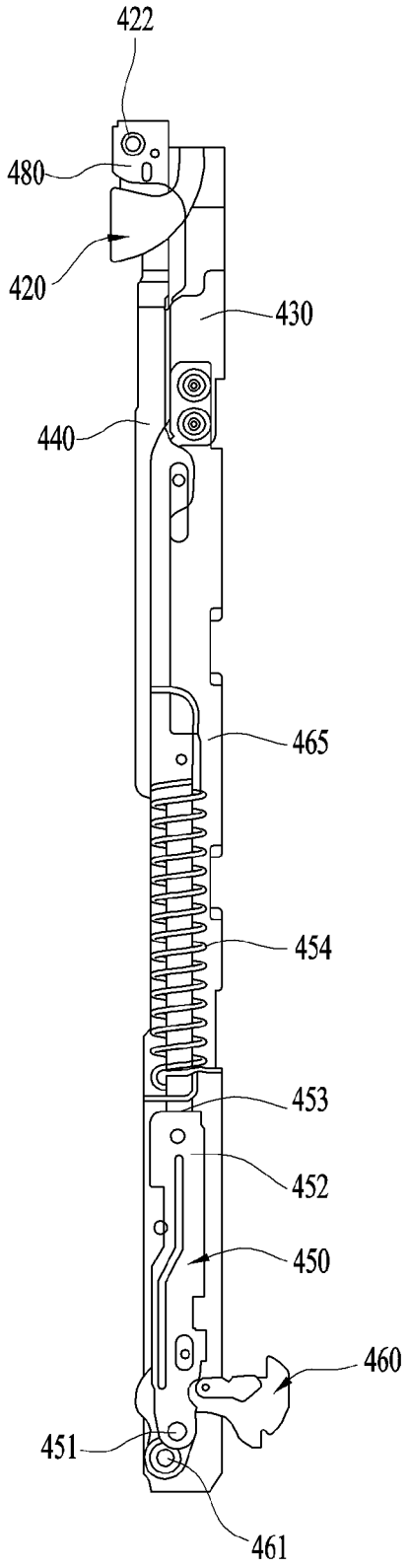
FIG. 3 is a side view illustrating one example of a handle assembly illustrated in FIG. 2.

FIG. 3 is a side view of the handle assembly 400 and, for convenience of description, illustrates only components provided inside the door 300. In other words, the handle 410, the door 300, and the cabinet are not illustrated in FIG. 3. The components inside the door 300 as well as the door 300 are connected to the cabinet using the hinge 460. The door 300 and the components inside the door 300 are rotated about a door rotating shaft 461 provided at the hinge 460. As the door 300 is opened, all components illustrated in FIG. 3 excluding the hinge 460 are rotated about the door rotating shaft 461.

At least one hinge housing 465 is rotated about the door rotating shaft 461, and the hinge 460 may be received in a lower region of the hinge housing 465. The hinge housing 465 is connected to the panels of the door 300 so as to be rotated together with the panels of the door 300. In addition to the hinge 460, the damper 450 may be received within the hinge housing 465. The damper 450 may be rotated about a link rotating shaft 451. The link rotating shaft 451 may be provided at the hinge 460. The link rotating shaft 451 may be referred to as a damper rotating shaft.

In the present embodiment, the single hinge or hinge assembly may include different rotating shafts, i.e. the door rotating shaft 461 and the damper rotating shaft (i.e. the link rotating shaft 451). The link rotating shaft 451 and the door rotating shaft 461 are eccentric to each other, and the link rotating shaft 451 and the door rotating shaft 461 are not configured to coaxial shafts. When the door 300 is rotated about the door rotating shaft 461, the damper 450 is rotated about the link rotating shaft 451. The difference between the centers of rotation of the door 300 and the damper 450 causes variation in the positional relationship between the damper 450 and the hinge housing 465 as the door 300 is rotated. In other words, the angle between the damper 450 and the hinge housing 465 varies.

As exemplarily illustrated in FIG. 3, the damper 450 and the hinge housing 465 have a prescribed acute angle when the door 300 is in a closed state. However, the angle is reduced as the door 300 is rotated. With the eccentric relationship between the centers of rotation of the damper 450 and the hinge housing 465, the handle link 420 may be rotated as the door 300 is rotated.

The damper 450 may include a damper housing 452, a damper rod 453, and a damper spring 454. The damper 450 may be received inside the hinge housing 465. The damper housing 452 is rotatably connected to the link rotating shaft or the damper rotating shaft 451. The damper housing 452 may also be connected to the damper rod 453. A damper spring 454 may be located around the damper rod 453 and function to ensure the smooth opening or closing of the door 300.

The damper 450 may implement the damping function because the damper housing 452, the damper rod 453, and the damper spring 454 are rotated about the damper rotating shaft 451. The damping function may be implemented due to the eccentric relationship between the damper rotating shaft (link rotating shaft) 451 and the door rotating shaft 461. The configuration of the damper 450 is well known and, a more detailed description thereof will be omitted hereinafter.

In the present embodiment, the link 440 is connected to the damper 450 so as to rotate the handle link 420. The link 440 may extend from the damper rod 453 to thereby be connected to the handle link 420. When the door 300 is rotated and opened, the link 440 pulls the handle link 420 to rotate the handle link 420. Since the handle link 420 is coupled to the handle 410, the position of the handle 410 relative to the front surface of the door 300 may vary via the rotation of the handle link 420.

The handle link 420 is rotated about a handle link rotating shaft 422 provided inside the door 300. A vertical load may be applied to the handle link rotating shaft 422 through the handle 410 and the handle link 420. As a result, a large force may be applied to the handle link rotating shaft 422, which may prevent the smooth rotation of the handle link 420.

To solve such a problem, the handle link bracket 430 may be provided to fix the handle link rotating shaft 422. The handle link bracket 430 is fixed inside the door 300, and the handle link rotating shaft 422 may be rotatably coupled to the handle link bracket 430. The handle link bracket 430 may be connected to the hinge housing 465. In other words, the handle link bracket 430 may extend upward from the upper end of the hinge housing 465.

Meanwhile, the left-right width (when viewed from the front or rear of the home appliance) of the upper side of the handle link bracket 430 may be greater than the left-right width of the hinge housing 465. In other words, the left-right width of the handle link bracket 430 may have a greater value at the position thereof to which the handle link rotating shaft 422 is fixed. This serves to increase the left-right width of the handle link rotating shaft 422 and the left-right width of the handle link 420.

A pair of the handle links 420 is provided respectively at the left and right sides of the door 300. In addition, each handle link 420 has a greater left-right width than the left-right width of the damper 450. As a result, the handle link 420 having enhanced reliability and strength may be provided, and the handle 410 may be more firmly connected to the door 300.

Figure 4:
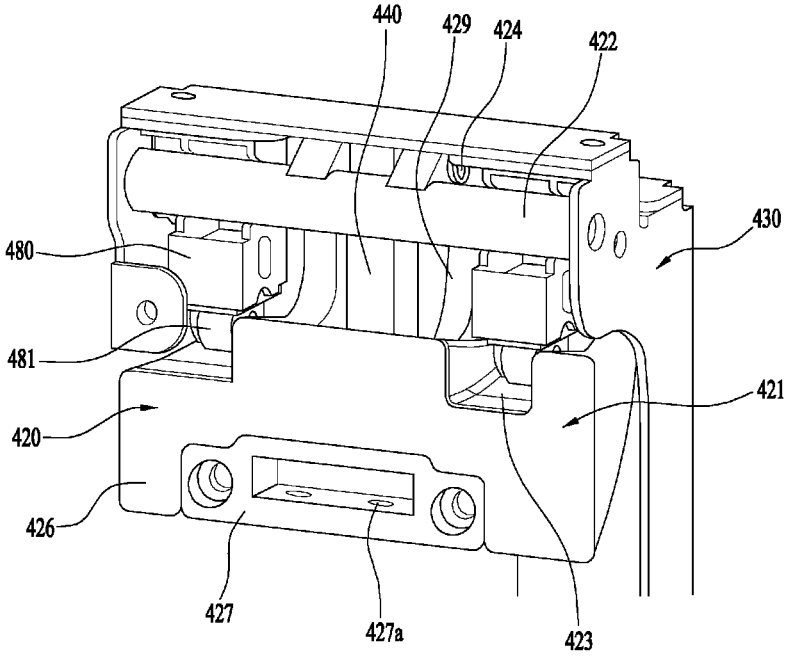
FIG. 4 is a front view illustrating a handle link portion of the handle assembly illustrated in FIG. 2.
Figure 5:
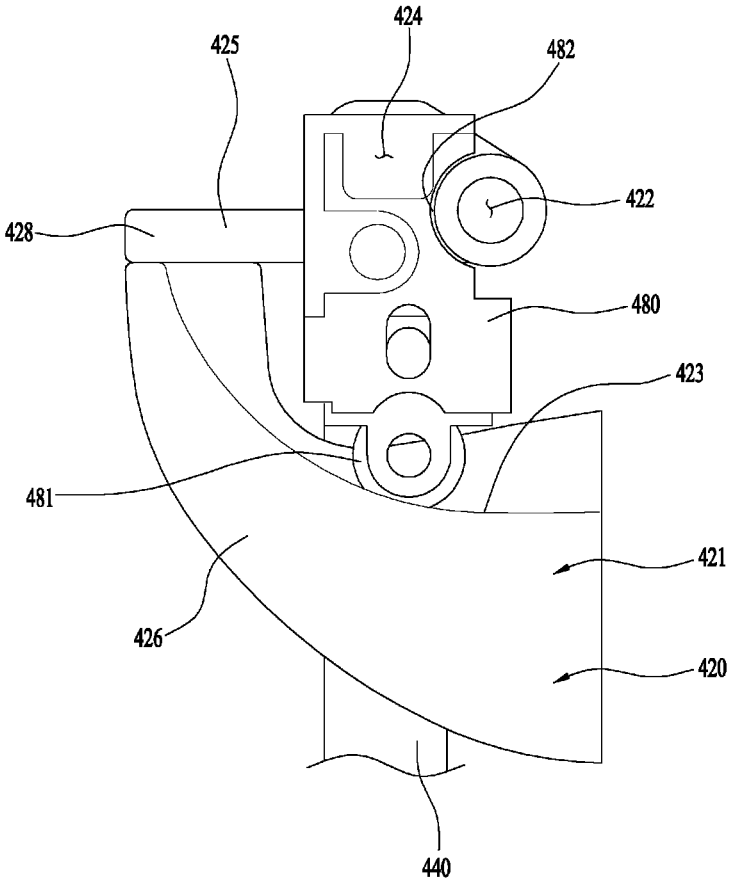
FIG. 5 is a side view of FIG. 4.

FIG. 4 is a front perspective view illustrating the coupled state of the handle link 420, a distance maintenance member or spacer 480, the link 440, and the handle link bracket 430, and FIG. 5 is a side view illustrating the components of FIG. 4 excluding the handle link bracket 430. The handle link 420 may include a handle link rotating shaft 422. The handle link 420 is rotated about the handle link rotating shaft 422 as the door 300 is rotated.

The handle link 420 may include a horizontal part 425 extending rearward from the handle link rotating shaft 422. Thus, the handle link rotating shaft 422 may be formed at one end of the horizontal part 425. The handle link 420 may include an extension part 421 which extends downward from the horizontal part 425 and then extends forward of the door 300.

The horizontal part 425 may extend rearward of the door 300 from the handle link rotating shaft 422 so as to be substantially parallel to the handle 410. In addition, the extension part 421 may extend downward from the horizontal part 425 and then extend forward of the door 300 so as to be connected at one end thereof to the handle 410.

The handle link 420 described above may be formed using a single member. However, in consideration of the fact that the opening/closing force of the door 300 as well as a vertical load may be applied to the handle link 420, the single handle link 420 may be formed by coupling a plurality of members to one another, in order to increase the strength of the handle link 420.

The horizontal part 425 may include the handle link rotating shaft 422 provided at one end thereof and a connecting portion 428 formed at the other end thereof. The horizontal part 425 may take the form of a single member. The extension part 421 may be connected to the connecting portion 428. The extension part 421 may extend downward from the connecting portion 428 and then extend forward of the door 300. The extension part 421 may take the form of a single member, or may be formed by coupling a plurality of members to one another.

As exemplarily illustrated in FIG. 4, the extension part 421 may include an inner extension part 427 and an outer extension part 426. The single extension part 421 may be formed by coupling the inner extension part 427 and the outer extension part 426 to each other. In addition, a handle coupling portion 427*a* may be formed at the inner extension part 427 or the outer extension part 426 such that the handle link 420 and the handle 410 are coupled to each other via the handle coupling portion 427*a*. The handle link rotating shaft 422 is rotatably fixed to the handle link bracket 430 such that the horizontal part 425 is rotatably fixed to the handle link bracket 430.

FIG. 5 illustrates the handle link 420 when the door 300 is in a closed state. As the door 300 is opened, the handle link 420 is rotated in the counterclockwise direction about the handle link rotating shaft 422. Then, in the state in which the door 300 is completely opened (i.e. the state in which the door 300 is opened by substantially 90 degrees with respect to the floor surface), the horizontal part 425 of the handle link 420 may be vertically oriented, and a large portion of the extension part 421 is exposed out of the door 300.

This rotation of the handle link 420 is linked to the rotation of the door 300, and the link 440 may be provided to implement the rotation linkage. The force required to rotate the handle link 420 is applied through the link 440. To this end, the handle link 420 may include a link connecting portion 424. The link connecting portion 424 may be located between the handle link rotating shaft 422 and the connecting portion 428.

As exemplarily illustrated in FIG. 5, the link 440 is connected to the link connecting portion 424. The link 440 may be rotatably connected to the link connecting portion 424. When the link 440 is pulled downward, the handle link 420 is rotated in the counterclockwise direction due to a moment distance between the link connecting portion 424 and the handle link rotating shaft 422. In contrast, the handle link 420 is rotated in the clockwise direction when the door 300 is closed.

The link 440 may extend downward from the link connecting portion 424 to thereby be connected to the damper rod 453. As such, the link connecting portion 424 is rotated about the link rotating shaft 451 as the door 300 is rotated. When the door 300 is rotated, the link 440 rotates the handle link 420 because the center of rotation of the door 300 differs from the center of rotation of the link 440.

The link connecting portion 424 is located between the rotating shaft 422 and the connecting portion 428 of the handle link 420. In practice, the link connecting portion 424 may be located higher than the rotating shaft 422. The link connecting portion 424 may be integrated with the rotating shaft 422 and the connecting portion 428 so as to form the horizontal part 425.

Owing to the position of the link connecting portion 424 described above, the handle link 420 may be formed with a perforation 429. The perforation 429 may be made in the center of the handle link 420. See, e.g., FIG. 7. The link 440 may extend downward of the link connecting portion 424 through the perforation 429. The perforation 429 may be configured to provide the link 440 with sufficient front and rear margin regions so as to allow the link 440 to vary in position relative to the handle link 420. Owing to this position of the perforation 429, the distance maintenance members 480 may be provided respectively at both sides of the perforation 429.

Accordingly, the left-right width of the handle link 420 may be increased, which may increase the rigidity of the handle link 420. In addition, it is possible to prevent leftward and rightward shaking of the handle 410 or the handle link 420. This is because the single handle link 420 may be supported at the left and right sides of the perforation 429.

As described above, large force may be applied to the handle link 420 regardless of the rotation of the handle link 420. For example, when the handle 410 illustrated in FIG. 2 is pulled vertically upward, the door 300 and the handle link 420 are not rotated. This is because the door 300 is not rotated when the force is applied in the direction described above. This force is applied to the handle link 420.

The shape of the horizontal part 425 and the extension part 421 of the handle link 420 may cause deformation or damage to the handle link 420. In particular, since there is a distance between the handle link rotating shaft 422 and the extension part 421, deformation or damage to the handle link 420 may occur such that the distance between the handle link rotating shaft 422 and the extension part 421 is reduced. Therefore, the distance maintenance members 480 may be provided in order to increase the strength of the handle link 420 and to more stabilize the handle link 420.

The distance maintenance members 480 may be located between the handle link 420 and the handle link rotating shaft 422 to maintain the distance between the handle link 420 and the handle link rotating shaft 422. One end of each distance maintenance member 480 may be connected to the handle link 420. The other end of the distance maintenance member 480 may extend to the handle link rotating shaft 422.

As described above, the handle link 420 may include the extension part 421. The extension part 421 is positioned so as to be spaced apart from the handle link rotating shaft 422. The distance maintenance members 480 may be provided between the handle link rotating shaft 422 and the extension part 421 so as to maintain the distance between the extension part 421 and the handle link rotating shaft 422. The distance maintenance members or spacers 480 may support the extension part 421 to prevent the extension part 421 from being deformed in such a way that the distance between the handle link rotating shaft 422 and the extension part 421 is reduced. Of course, the handle link 420 may be allowed to rotate about the handle link rotating shaft 422 despite the provision of the distance maintenance members 480. The distance maintenance members 480 may be provided so as not to restrict the rotation of the handle link 420.

As exemplarily illustrated in FIG. 5, the distance maintenance members 480 may be vertically oriented when the door 300 is in a closed state. That is, the distance maintenance members 480 may be positioned to support the vertical upward force applied to the handle link 420 through the handle 410. The radius of rotation of the extension part 421 relative to the handle link rotating shaft 422 is fixed through the horizontal part 425. However, since the horizontal part 425 extends substantially horizontally when the door 300 is in a closed state, the horizontal part 425 cannot support a vertical load applied to the handle link 420. The distance maintenance members 480, which are oriented substantially perpendicular to the horizontal part 425, may support the vertical load.

The distance maintenance members 480 may be fixed inside the handle link bracket 430. The distance maintenance members 480 are fixed, and the handle link 420 is movable relative to the distance maintenance members 480. To this end, one end 481 of each distance maintenance member 480 may allow the sliding of the handle link 420. The other end 482 of the distance maintenance member 480 may allow the rotation of the handle link rotating shaft 422.

The end 481 of the distance maintenance member 480 may have an arc shape, and a rolling guide 423 may be formed at the extension part 421 of the handle link 420 so as to correspond to the arc-shaped end 481. The rolling guide 423 may have an arc shape such that the rolling guide 423 has a constant radius with respect to the handle link rotating shaft 422. The end 481 of the distance maintenance member 480 may slide along the rolling guide 423 as the handle link 420 is rotated. The contact between the handle link 420 and the distance maintenance member 480, i.e., force transmission, is maintained which enables the rotation of the handle link 420.

The distance maintenance member 480 may serve to support the handle link 420 so as to maintain the shape of the handle link 420. The distance maintenance member 480 may serve to maintain the radius of rotation of the handle link 420 with respect to the handle link rotating shaft 422. In this way, the distance maintenance member 480 may support the external force applied to the handle link 420 in the direction in which the radius of rotation of the handle link 420 is reduced. Through the provision of the distance maintenance members 480, it is possible to prevent damage to the handle link 420 and to ensure the more smooth rotation of the handle link 420.

The handle 410 may remain in close contact with the front surface of the door 300 when the door 300 is in a closed state. The handle 410 may not be moved forward and rearward, or upward and downward when the door 300 is in a completely closed state. This is because the reliability of a product may be deteriorated when the handle 410 is moved by a small force when the door 300 is in a closed state. To solve this problem, an elastic member 490 may be provided.

Figure 6:
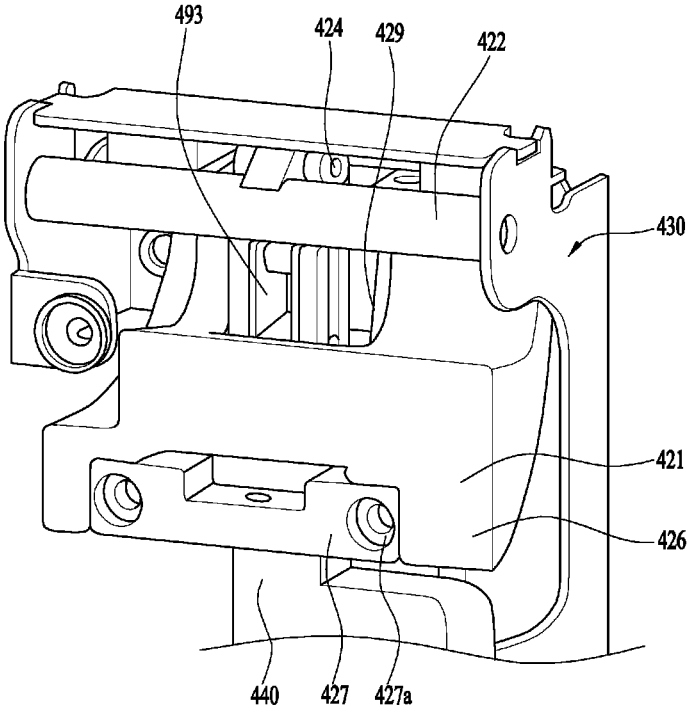
FIG. 6 is a front perspective view illustrating a handle link portion of another example of the handle assembly illustrated in FIG. 2.
Figure 7:
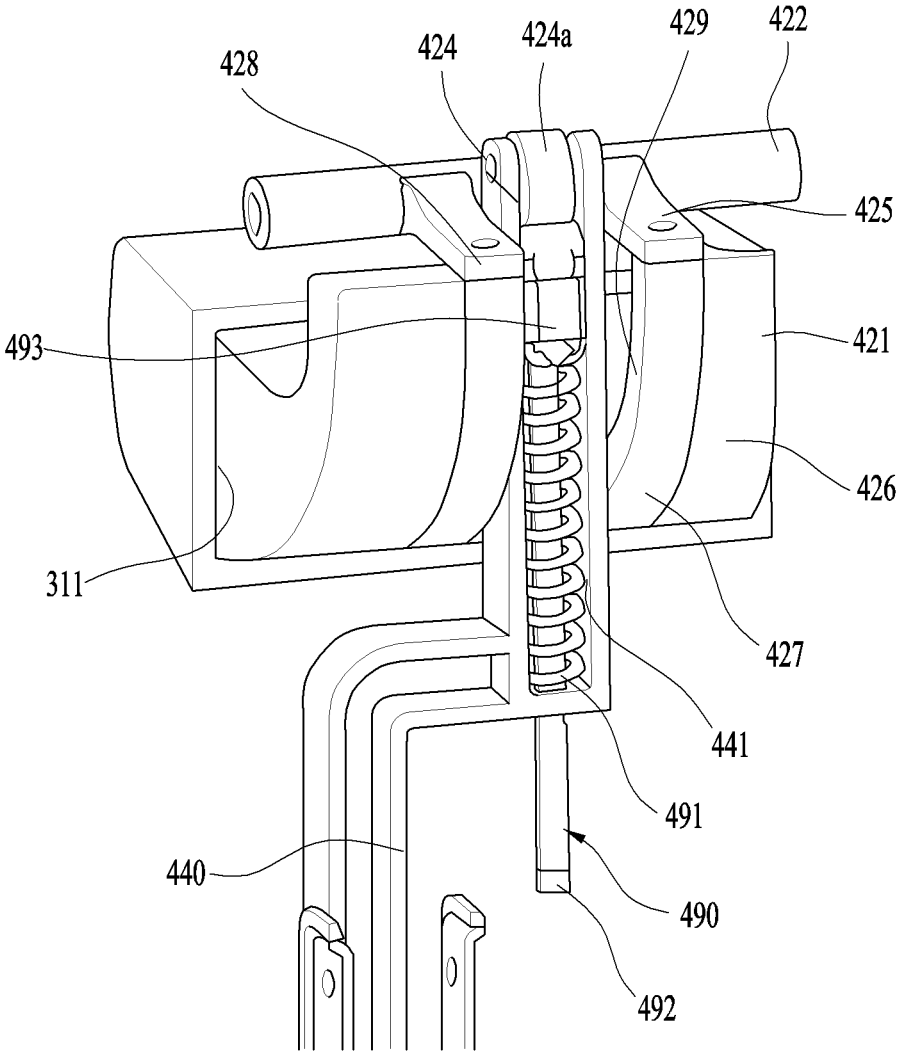
FIG. 7 is a rear perspective view of FIG. 6.

One embodiment of the present disclosure using the elastic member 490 will be described in brief with reference to FIGS. 6 and 7. The present embodiment may be applied in combination with the embodiment using the distance maintenance members 480 described above, or may be applied separately from the distance maintenance member 480. For convenience of description, in FIGS. 6 and 7, the distance maintenance member 480 may be omitted. In the present embodiment, the handle link 420, the handle link bracket 430, and the link 440 may be the same as or similar to the above-described embodiment.

The handle link 420 and the handle 410 are rotated in the clockwise direction as the door 300 is opened. The handle link 420 and the handle 410 are rotated in the counterclockwise direction as the door 300 is closed. The handle link 420 and the handle 410 may not be allowed to be rotated in the counterclockwise direction when the door 300 is completely closed. For example, this rotation restriction may be implemented when the handle 410 comes into close contact with the contact member 312 to thereby be no longer rotatable.

In other words, the handle 410 may come into close contact with the front surface of the door 300 when the door 300 is in a completely closed state. To this end, the elastic member 490 may serve to provide the handle link 420 with elastic restoration force required to return the handle link 420 to the initial state in which the door 300 is closed.

Specifically, in the state in which the handle 410 or the handle link 420 are no longer rotatable in the counterclockwise direction (i.e. in the initial state in which the door is completely closed), the force to rotate the handle link 420 in the counterclockwise direction may be applied. This force causes the handle 410 to come into closer contact with the contact member 312.

In addition, the handle 410 is slightly pulled in the state in which the door 300 is not opened and, thereafter, when the pull force is removed, the handle 410 may again come into contact with the contact member 312. As such, the elastic member 490 may apply the elastic restoration force required to return the handle 420 to the initial state thereof. The elastic member 490 may apply the elastic restoration force to the handle link 420 so as to rotate the handle link 420 in the direction opposite to the rotation direction of the handle link 420 when the door 300 is opened.

The elastic member 490 may take the form of a torsion spring which provides the handle link rotating shaft 422 with the elastic restoration force. However, the torsion spring may problematically continuously apply the elastic restoration force even after the door 300 is completely opened, rather than being applied in the initial state. In other words, the amount of elastic restoration may increase as the opening angle of the door 300 increases. This means that elastic restoration force, which must be overcome, increases as the opening angle of the door 300 increases. In addition, the size of the spring may increase as the amount of elastic restoration increases. Therefore, the elastic member may be configured to increase or reduce the amount of elastic restoration only for a certain period between the initial state of the door 300 and the maximally open state of the door 300.

The elastic member 490 may be in an elastically deformed state in the initial state of the door 300, and may reach the maximally elastically deformed state after the door 300 is opened to some extent (e.g., in an opened state of 10%). The elastic member 490 may no longer increase the elastic deformation thereof when the door 300 is opened further. To this end, the link connecting portion 424 may include a cam 424*a*. Since the link 440 is rotatably connected to the link connecting portion 424, the positional relationship between the link 440 and the cam 424*a* may vary as the rotation angle of the link 440 with respect to the link connecting portion 424 varies.

The elastic member 490 may be provided at the link 440. Specifically, the elastic member 490 may be provided in an elastic member receiving region 441 formed in the link 440. The elastic member 490 may extend in the same direction as the longitudinal direction of the link 440. The elastic member 490 may include a cam connecting portion 493, an elastic member rod 492, and a spring 491. The spring 491 may be located around the elastic member rod 492, and may be elastically deformed in the longitudinal direction within the elastic member receiving region 441.

The spring 491 is elastically deformed as the cam connecting portion 493 is vertically moved. When the cam connecting portion 493 is moved downward, the cam connecting portion 493 additionally pushes the spring 491 provided in the elastic member receiving region 441. The spring 491 is in an elastically deformed state even in the initial state (i.e. when the door 300 is in a completely closed state). As such, the spring 491 applies the elastic restoration force to raise the cam connecting portion 493 in the initial state. With this elastic restoration force, the handle link 420 tends to be rotated in the closing direction of the door 300 in the initial state, and the handle 410 may come into closer contact with the door 300 in the initial state.

When the door 300 begins to be opened, the cam connecting portion 493 is rotated relative to the cam 424*a*, thereby being moved downward. As the opening angle of the door 300 increases, the position of the outer surface of the cam 424*a*, which comes into contact with the cam connecting portion 493, varies. In other words, the distance between the cam connecting portion 493 and the center of the cam 424*a* varies. This may be an inherent characteristic of the cam 424*a*.

The spring 491 is elastically deformed further, resulting in increased elastic restoration force. As a result, the elastic restoration force gradually increases within the initial opening angle range of the door 300 (e.g., an opening angle of about 10%). However, due to the shape characteristics of the cam 424*a*, when the door 300 is further opened beyond the initial angle, the elastic restoration force is gradually reduced. The minimum elastic restoration force may be maintained, and in contrast, the elastic restoration force may disappear.

With the relationship between the cam 424*a* and the spring 491, the elastic restoration force may gradually increase until the initial opening angle of the door 300 is realized when the door 300 is in a completely closed state. This may prevent the elastic restoration force from gradually increasing throughout the opening operation of the door 300 as the opening angle of the door 300 increases. Accordingly, the elastic restoration force may be limited to increase only until the handle 410 needs to accurately return to the initial state thereof. The elastic member rod 492 functions to prevent the spring 491 from being separated from the elastic member receiving region 441.

According to an embodiment of the present disclosure, it is possible to provide a home appliance, which can prevent a handle from deviating or being blocked from the visual field of a user when opening or closing a door, resulting in enhanced user convenience when the user opens and then closes the door.

According to an embodiment of the present disclosure, it is possible to provide a home appliance, which may prevent the wrist of a user from being bent when opening or closing a door and consequently prevent the back of the hand or the wrist of the user from being pushed by an edge of the door, resulting in enhanced user convenience.

According to an embodiment of the present disclosure, it is possible to provide a home appliance in which a handle is variable in position as a door is rotated, which may eliminate a need for a user to change a hand's posture of gripping the handle in the course of opening or closing the door, resulting in enhanced user convenience.

According to an embodiment of the present disclosure, it is possible to provide a home appliance, which may be easily applied regardless of the opening or closing type of a door, resulting in easy manufacture and enhanced user convenience.

According to an embodiment of the present disclosure, it is possible to provide a home appliance in which a handle is movable dependent on and proportional to rotation of a door, which may prevent a user from confusing opening or closing of the door with movement of the handle.

According to an embodiment of the present disclosure, it is possible to provide a home appliance, which may prevent occurrence of accidents when opening or closing a door by assisting a user in continuously applying minimum force through a handle when opening or closing the door.

According to an embodiment of the present disclosure, it is possible to provide a home appliance, which may provide a handle with a greater moment distance required to rotate and opening or close a door relative to a conventional handle, thereby assisting a user in more easily opening or closing the door.

According to an embodiment of the present disclosure, it is possible to provide a home appliance, which implement a more stable and firm rotation linkage mechanism between a door and a handle and, more particularly, may effectively and stably support the handle when a vertical load is applied through the handle.

According to an embodiment of the present disclosure, it is possible to provide a home appliance, which may allow a handle to come into close contact with the front surface of a door when the door is in a closed state.

In accordance with the present disclosure, a home appliance includes a cabinet having a chamber for reception of an object, a door configured to open or close the chamber by being rotated about a door rotating shaft, and a handle assembly provided at the exterior of a front surface of the door, the handle assembly including a handle configured to assist a user in opening or closing the door, wherein the handle assembly further includes a handle link configured to be rotated integrally with the handle, the handle link being exposed out of the door by an increasing length as an opening angle of the door increases, a handle link rotating shaft forming a center of rotation of the handle link, and a distance maintenance member provided between the handle link and the handle link rotating shaft to maintain a distance between the handle link and the handle link rotating shaft.

The handle may be located at the exterior of the front surface of the door. More specifically, the handle may be located at the exterior of the front surface of the door when the door is in a closed state, and the handle may be variable in position relative to the door via rotation of the handle link as the door is rotated and opened. That is, as the length of a portion of the handle link, exposed out of the front surface of the door, varies, a distance between the front surface of the door and the handle varies. Specifically, there is substantially no distance between the front surface of the door and the handle when the door is in a closed state, and the distance may increase as an opening angle of the door increases.

The home appliance may further include a handle link bracket fixed inside the door to rotatably fix the handle link rotating shaft. The distance maintenance member may be connected at one end thereof to the handle link. The handle link may be formed with an arc-shaped rolling guide having a constant radius with respect to the rotating shaft, and the end of the distance maintenance member may slide along the rolling guide as the handle link is rotated. The distance maintenance member may be fixed to the handle link bracket, and the other end of the distance maintenance member may be rotatably connected to the handle link rotating shaft.

The home appliance or the handle assembly may further include a link connected to the handle link to convert an angle of rotation of the door into an angle of rotation of the handle link. The handle link may include a horizontal part extending rearward of the door from the handle link rotating shaft so as to be substantially parallel to the handle, and an extension part extending downward from the horizontal part and then extending forward of the door so as to be connected at one end thereof to the handle.

The horizontal part may include the handle link rotating shaft formed at one end thereof, a connecting portion provided at the other end thereof so as to be connected to the extension part, and a link connecting portion formed between the handle link rotating shaft and the connecting portion so as to be connected to one end of the link. The link may be rotated about a link rotating shaft, provided at a position eccentric to the door rotating shaft, as the door is rotated.

The distance maintenance member may be provided between the handle link rotating shaft and the extension part. The distance maintenance member may be vertically oriented when the door is in a closed state, in order to support vertical upward force applied to the handle link through the handle.

The home appliance may further include a hinge having the door rotating shaft and a damper rotating shaft eccentric to the door rotating shaft. The link may rotate the handle link by being rotated about the damper rotating shaft as the door is rotated.

The home appliance may further include an elastic member configured to provide the handle link with elastic restoration force so as to return the handle link to an initial state in which the door is closed. The elastic member may apply the elastic restoration force to the handle so as to rotate the handle link in a direction opposite to a rotation direction of the handle link when the door is opened. The handle link may include a cam configured to be rotated about the handle link rotating shaft, and elastic restoration of the elastic member increases by the cam.

In accordance with another embodiment of the present disclosure, a home appliance includes a cabinet having a chamber for reception of an object, a door configured to open or close the chamber by being rotated about a door rotating shaft, and a handle provided at the exterior of a front surface of the door, the handle being configured to assist a user in opening or closing the door, a handle link configured to be rotated integrally with the handle, the handle link being exposed out of the door by an increasing length as an opening angle of the door increases, a handle link rotating shaft forming a center of rotation of the handle link, a link connecting portion provided at the handle link at a position eccentric to the handle link rotating shaft, a link connected to the link connecting portion to convert rotation of the door into rotation of the handle link, and a distance maintenance member provided between the handle link and the handle link rotating shaft to continuously maintain a constant distance between the handle link and the handle link rotating shaft regardless of an angle of rotation of the handle link.

The link connecting portion may be configured into a cam, and the home appliance may further include an elastic member configured to apply elastic restoration force to the cam by coming into contact with the cam, so as to return the handle link to an initial state in which the door is closed.

In accordance with a further embodiment of the present disclosure, a home appliance includes a cabinet having a chamber for reception of an object, a door configured to open or close the chamber by being rotated about a door rotating shaft, a handle provided at the exterior of a front surface of the door, the handle being configured to assist a user in opening or closing the door, a handle link configured to be rotated integrally with the handle, the handle link being exposed out of the door by an increasing length as an opening angle of the door increases, a handle link rotating shaft forming a center of rotation of the handle link, a link connecting portion provided at the handle link at a position eccentric to the handle link rotating shaft, a link connected to the link connecting portion to convert rotation of the door into rotation of the handle link, and an elastic member configured to apply elastic restoration force to the handle link when the door is in a closed state, so as to rotate the handle link in a direction opposite to a rotation direction of the handle link when the door is opened.

The elastic member may include a coil spring. In addition, the coil spring may extend in the longitudinal direction of the link. In particular, the coil spring may be located within the link to extend in the longitudinal direction of the link. To this end, the link may have an elastic member receiving region.

The elastic member may include a deformation member, which moves vertically to elastically deform the coil spring. The deformation member may be configured to come into contact with the cam of the link connecting portion. As a position of the deformation member coming into contact with the cam varies, the deformation is variable in length required to elastically deform the coil spring.

With the connection relationship between the cam and the coil spring, elastic restoration force may be increased only to the extent which allows the closed door to be opened by a prescribed angle. That is, it is possible to prevent the elastic restoration force from being continuously increased until the closed door is completely opened. As such, it is possible to prevent the elastic restoration force, which should be overcome, from being excessively increased as the opening angle of the door increases.

Accordingly, it is possible to prevent easy shaking or movement of the handle when the door is in a closed state. In addition, through the combination of the elastic member and the distance maintenance member, it is possible to prevent damage to the handle link even when a vertical load is applied to the handle.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home appliance comprising:

a cabinet having a chamber, a door configured to open or close the chamber by being rotated about a door rotating shaft; and a handle assembly provided at the door, wherein the handle assembly includes:

a handle;

a handle link rotating shaft;

a handle link attached to the handle, the handle link being rotatable about the handle link rotating shaft as the door is rotated to an open position and extending out of the door in an increasing length as an opening angle of the door increases; and a distance spacer provided between the handle link and the handle link rotating shaft to maintain a distance between the handle link and the handle link rotating shaft, wherein a first end of the distance spacer is slidably supported on the handle link and a second end of the distance spacer is rotatably connected to the handle link rotating shaft.

2. The home appliance according to claim 1, wherein the handle is located at an exterior of the front surface of the door when the door is in a closed state, and the handle is variable in position relative to the door via rotation of the handle link as the door is rotated and opened.

3. The home appliance according to claim 2, further comprising a handle link bracket fixed inside the door to rotatably fix the handle link rotating shaft.

4. The home appliance according to claim 3, wherein the distance spacer is fixed to the handle link bracket.

5. The home appliance according to claim 1, wherein the handle link is formed with an arc-shaped rolling guide having a constant radius with respect to the rotating shaft, and the end of the distance spacer slides along the rolling guide as the handle link is rotated.

6. The home appliance according to claim 1, further comprising a link connected to the handle link to convert an angle of rotation of the door into an angle of rotation of the handle link.

7. The home appliance according to claim 6, wherein the handle link includes:

a horizontal plate extending rearward of the door from the handle link rotating shaft so as to be substantially parallel to the handle; and an extension extending downward from the horizontal plate and then extending forward toward the door so as to be connected at one end thereof to the handle.

8. The home appliance according to claim 7, wherein the handle link rotating shaft is provided at one end of the horizontal plate, and the other end of the horizontal plate is attached to the extension.

9. The home appliance according to claim 8, wherein the link is rotated about the link rotating shaft, which is provided at a position eccentric to the door rotating shaft, as the door is rotated.

10. The home appliance according to claim 7, wherein the distance spacer is provided between the handle link rotating shaft and the extension.

11. The home appliance according to claim 10, wherein the distance spacer is vertically oriented when the door is in a closed state, in order to provide support when a vertical upward force is applied to the handle link through the handle.

12. The home appliance according to claim 6, further comprising a hinge having the door rotating shaft and a damper rotating shaft eccentric to the door rotating shaft.

13. The home appliance according to claim 12, wherein the link rotates the handle link by being rotated about the damper rotating shaft as the door is rotated.

14. The home appliance according to claim 1, further comprising an elastic spring configured to provide the handle link with elastic restoration force so as to return the handle link to an initial state when the door is closed.

15. The home appliance according to claim 14, wherein the elastic spring applies the elastic restoration force to the handle so as to rotate the handle link in a direction opposite to a rotation direction of the handle link when the door is opened.

16. The home appliance according to claim 15, wherein the handle link includes a cam configured to be rotated about the handle link rotating shaft, and the cam increases elastic restoration of the elastic spring.

17. A home appliance comprising:

a cabinet having a chamber;

a door configured to open or close the chamber by being rotated about a door rotating shaft;

a handle provided at the exterior of a front surface of the door;

a handle link rotating shaft;

a handle link attached to the handle, the handle link being rotatable about the handle link rotating shaft as the door is rotated to an open position and extending out of the door in an increasing length as an opening angle of the door increases;

a link connecting portion provided at the handle link at a position eccentric to the handle link rotating shaft;

a link connected to the link connecting portion to convert rotation of the door into rotation of the handle link; and a distance maintenance member provided between the handle link and the handle link rotating shaft to continuously maintain a constant distance between the handle link and the handle link rotating shaft regardless of an angle of rotation of the handle link, wherein a first end of the distance maintenance member is slidably supported on the handle link and a second end of the distance maintenance member is rotatably connected to the handle link rotating shaft.

18. The home appliance according to claim 17, wherein the link connecting portion is configured into a cam, and the home appliance further comprises an elastic spring configured to apply elastic restoration force to the cam by coming into contact with the cam, so as to return the handle link to an initial state when the door is closed.

19. A home appliance comprising:

a cabinet having a chamber;

a door configured to open or close the chamber by being rotated about a door rotating shaft;

a handle provided at the exterior of a front surface of the door;

a handle link rotating shaft;

a handle link attached to the handle, the handle link being rotatable about the handle link rotating shaft as the door is rotated to an open position and extending out of the door in an increasing length as an opening angle of the door increases;

a link connecting portion provided at the handle link at a position eccentric to the handle link rotating shaft;

a link connected to the link connecting portion to convert rotation of the door into rotation of the handle link; and an elastic spring configured to apply elastic restoration force to the handle link when the door is in a closed state, so as to rotate the handle link in a direction opposite to a rotation direction of the handle link when the door is opened, wherein the elastic spring is provided between the link and the link connecting portion.

* * * * *